US010589278B2

(12) United States Patent
Johnson et al.

(10) Patent No.: US 10,589,278 B2
(45) Date of Patent: Mar. 17, 2020

(54) WEAR CAP FOR AN EARTH WORKING ROLL

(71) Applicant: ESCO Corporation, Portland, OR (US)

(72) Inventors: Erik L. Johnson, Edmonton (CA); Stephen M. Lafond, Millet (CA); Cameron R. Leedham, Portland, OR (US); Boyan K. Bahnev, Edmonton (CA)

(73) Assignee: ESCO GROUP LLC, Portland, OR (US)

( * ) Notice: Subject to any disclaimer, the term of this patent is extended or adjusted under 35 U.S.C. 154(b) by 807 days.

(21) Appl. No.: 14/778,550

(22) PCT Filed: Mar. 18, 2014

(86) PCT No.: PCT/US2014/031095
§ 371 (c)(1),
(2) Date: Sep. 18, 2015

(87) PCT Pub. No.: WO2014/153361
PCT Pub. Date: Sep. 25, 2014

(65) Prior Publication Data

US 2016/0290134 A1 Oct. 6, 2016

Related U.S. Application Data

(60) Provisional application No. 61/803,043, filed on Mar. 18, 2013.

(51) Int. Cl.
*E21C 25/18* (2006.01)
*E21C 35/18* (2006.01)
(Continued)

(52) U.S. Cl.
CPC ..... *B02C 4/305* (2013.01); *B28D 1/188* (2013.01); *E02F 9/2825* (2013.01);
(Continued)

(58) Field of Classification Search
CPC ..... E21C 35/18; E21C 35/183; E21C 2035/1816; B28D 1/186; B28D 1/188;
(Continued)

(56) References Cited

U.S. PATENT DOCUMENTS 1,384,701 A * 7/1921 McMonegal ..... E02F 9/2825 37/454
1,834,514 A * 12/1931 Brune ..... E02F 9/2825 37/456
(Continued)

FOREIGN PATENT DOCUMENTS

SU 1201428 12/1985
WO WO 2004/057117 7/2004
(Continued)

*Primary Examiner* — Shelley M Self
*Assistant Examiner* — Smith Oberto Bapthelus
(74) *Attorney, Agent, or Firm* — John Anderton

(57) ABSTRACT

A wear cap for use on an earth working roil for mining, construction and public works machines such as crushers, surface miners, milling machines and the like includes a working end and a rear mounting end. The rear mounting end including a pair of top and bottom rearwardly extending protrusions, a retainer, and a cavity having side stabilizing surfaces and a top and bottom rail or groove to support the wear cap on a holder mounted to the earth working roll.

8 Claims, 8 Drawing Sheets

(51) Int. Cl.

| | |
|---|---|
| ***E21C 35/183*** | (2006.01) |
| ***B02C 4/30*** | (2006.01) |
| ***E02F 9/28*** | (2006.01) |
| ***B28D 1/18*** | (2006.01) |

(52) U.S. Cl.
CPC ..... *E02F 9/2833* (2013.01); *E02F 9/2858* (2013.01); *E02F 9/2866* (2013.01); *E21C 25/18* (2013.01); *E21C 35/18* (2013.01); *E21C 35/183* (2013.01); *B02C 2210/02* (2013.01)

(58) Field of Classification Search
CPC ..... B02C 4/305; B02C 2210/02; E02F 9/28; E02F 9/2825; E02F 9/2833; E02F 9/2866
USPC ..... 241/197, 305; 175/327, 389; 299/79.1, 299/112, 113; 37/450–456
See application file for complete search history.

(56) References Cited

U.S. PATENT DOCUMENTS 3,510,076 A * 5/1970 Perdue ..... B02C 13/28 241/197
3,544,166 A * 12/1970 Proctor ..... E21C 35/18 299/103
3,897,642 A * 8/1975 Helton ..... E02F 9/2825 172/713
4,202,504 A * 5/1980 Cameron ..... B02C 13/28 241/194
7,377,459 B2 5/2008 Potts
7,703,224 B2 * 4/2010 Karlsson ..... E02F 9/2825 37/457
7,730,645 B2 * 6/2010 Ollinger, IV ..... E02F 9/2825 299/102
8,814,073 B2 8/2014 Barber
9,222,353 B2 * 12/2015 Morris ..... E21C 35/1933
2003/0037468 A1 * 2/2003 Adamic ..... E02F 9/2833 37/455
2003/0099514 A1 * 5/2003 Livesay ..... B60B 15/025 404/124
2007/0044349 A1 * 3/2007 McClanahan ..... E02F 9/2883 37/452
2014/0239106 A1 * 8/2014 Graham ..... B02C 13/04 241/194
2016/0290134 A1 * 10/2016 Johnson ..... B28D 1/188

FOREIGN PATENT DOCUMENTS

WO WO 2007/027639 3/2007
WO WO 2009/089322 7/2009

* cited by examiner

WEAR CAP FOR AN EARTH WORKING ROLL

RELATED APPLICATION

This application claims priority benefits to U.S. Provisional Patent Application No. 61/803,043 filed Mar. 18, 2013 and entitled "Wear Cap for an Earth Working Roll," which is incorporated herein by reference in its entirety.

FIELD OF THE INVENTION

The present invention pertains to a cap for an earth-working roll such as used in a roll crusher, surface miner, underground mining machines, milling machine and the like.

BACKGROUND OF THE INVENTION

A number of machines involved in mining, construction and public works use rolls that are driven for the crushing, mining, milling and the like of earthen materials. These earth working rolls include an array of wear assemblies to engage the material to be worked. The assemblies generally include a component with an impact face that is releasably secured to a base attached to the roll. These components with the impact face are wear parts that are replaced after a certain length of use.

As one example, earth working tips can be provided in a roll crusher for the processing of earthen material in a mining operation. FIG. 1 shows a double roll crusher 10 including a pair of opposed rolls 12 to break up the mined material 14. Each roll 12 is fitted with an array of tips 20 configured to impact and separate the material. The tips are fixed to the roils 12. Generally, the rolls 12 are rotated in opposite directions so that the tips 20 are driven toward each other from the top during normal operation. However, the rolls may be operated in the opposite direction for clearing the crusher. Additionally the rolls may be designed so that the tips are driven toward each other at the bottom of the roll during normal operation. The broken material 14A passing through the roll crusher is deposited on a conveyor for transport to additional processing.

This kind of machinery is generally capital equipment and an important part of the processing operation. Minimizing downtime for maintenance and refurbishment of wear components is a priority. With an array of tips, tip replacement can take the equipment out of service for extended periods.

The tips are close fitting with the bases to provide sufficient support for the tip. Even so, due to the invasiveness of earthen fines and the chaotic nature of a crushing or mining operation, fines commonly get embedded in crevices and openings. The fines consolidate into a concretion with the consistency like concrete and bind mated surfaces. Applied force or a cutting torch is often necessary to separate the components. Hammering and prying of the components may be required which can result in breakage and shrapnel from the target components.

SUMMARY OF THE INVENTION

The present invention pertains to an improved wear cap assembly for use on earth working rolls for mining, construction and public works machines such as crushers, surface miners, underground mining machines, milling machines and the like.

Extreme wear associated with the operation of a driven roll is experienced primarily on the front end of the component striking the earthen material, and in the primary direction of flow of the material in the crusher. As a result, this component wears out well before the other components in the crusher. With this present construction, only the wear cap needs to be replaced, and successive wear caps can be mounted onto the same base. By replacing only the wear cap, less discarded material is generated and fewer steps are required than replacing a conventional tip for less equipment downtime. The present construction allows for a cost effective component. In a preferred construction, the wear caps are cast without the need to machine the part.

In accordance with one aspect of the invention, the wear cap assembly comprises a wear cap that engages the earthen material and a base attached to the roll. The wear cap includes a flange extending rearwardly that is received into a recess of the base. A retainer releasably secures the wear cap to the base.

In accordance with another aspect of the invention, the wear cap assembly includes a wear cap with a cavity for receiving a seat of the base. The wear cap and seat include rearwardly extending rails and grooves on top and bottom surfaces to stabilize and securely hold the wear cap to the base. During operation the wear cap impacts material at high speed and experiences significant loading. The grooves receive the rails on assembly and, together with corresponding side surfaces of the seat and the cavity resist and absorb side impacts on the wear cap. The corresponding top and bottom surfaces of the wear cap and the seat resist and absorb vertical impacts to the wear cap.

Renewing worn wear caps on a driven roll can also be accomplished easily and quickly without hammering. In a method in accordance with the present invention a retainer holding the worn cap to the base is released. Each worn wear cap is separated from the seat of its base and a wear cap flange is separated from a recess of the base. A new wear cap receives the seat where the worn wear cap was removed and the recess receives the flange of the new wear cap. Each newly installed wear cap is then secured to the seat with a retainer.

In another aspect of the invention, a single retainer is positioned in a rearward extension of the wear cap to secure the wear cap onto the seat of the base. The retainer preferably extends through threaded and unthreaded portions of the wear cap and the seat though other arrangements are possible. The retainer is loaded in shear where it is oriented transversely to the longitudinal axis. In an alternative embodiment the retainer is oriented along the longitudinal axis and is loaded in tension to retain the wear cap to the seat. The retainer acts to limit separation of the wear cap from the base.

In another aspect of the invention, at least one flange extends rearwardly from the wear cap and engages a recess of the base. In a preferred embodiment the flange is straight. In an alternative embodiment the flange and the recess are both curved. To engage the flange in the curved recess the end of the flange is positioned at the opening of the recess. The wear cap is rotated about the axis of curvature of the flange and recess so the flange advances into the recess. The upper surface of the seat preferably is curved with an axis of curvature similar to that of the recess so the cavity of the wear cap fully seats on the base without interference. Nevertheless, other shapes are possible to achieve the same result.

In another aspect of the invention, a retainer on advancing through the opening preferably takes up the gap between opposing faces of the seat and the wear cap cavity such as corresponding bottom surfaces and corresponding thrust faces. Tightening the retainer increases the preload stress between these surfaces to limit movement between the wear cap and the seat during operation.

In another aspect of the invention, the wear cap includes a pair of rearward projections, one along its top surface and one along its bottom surface. The pair of rearward projections are received in corresponding recesses or notches in the base for additional support in resisting the applied loads. In the first embodiment illustrated herein, one projection is supported on the top and bottom projection surfaces and the second projection is supported along opposite sidewalls. The projections could both be supported along top and bottom surfaces or both supported on side surfaces, or along the top, bottom and side surfaces. The projections could be supported in reverse positions from what is illustrated or only one projection may be provided.

In another aspect of the invention, the wear cap assembly includes a wear cap with a cavity for receiving a seat of the base. Both the wear cap and the seat include a pair of side stabilizing surfaces separated by a transition surface on each sidewall. The use of side stabilizing surfaces separated by a transition surface on each side wall provides a stable mounting of the wear cap and enables the seat to be widened for greater strength.

DETAILED DESCRIPTION OF THE PREFERRED EMBODIMENTS

The present invention pertains to wear cap assemblies for an earth working roll or roller such as used in roll crushers, surface miners, milling machines and the like. The wear caps and assemblies in this application are described primarily in the context of a double roll crusher, but the invention is not limited to this operation. Wear cap assemblies in accordance with the invention are also suitable for use in conjunction with other earth working machines involving the use of driven rolls with caps such as single roll crushers, scroll crushers, surface miners, underground mining machines, milling machines and the like.

Figure 1:
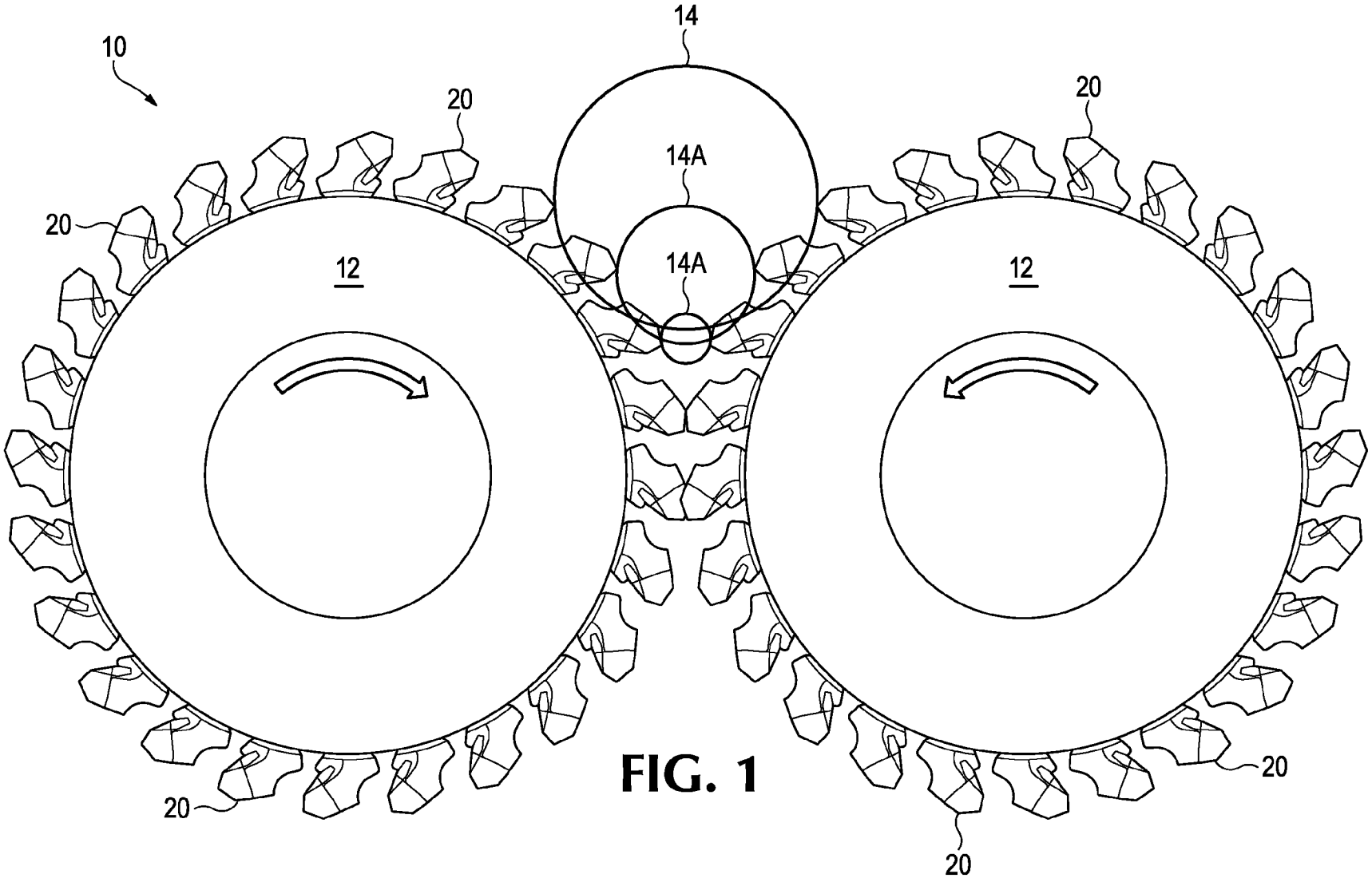
FIG. 1 is a schematic illustration of the operation of the rolls in a double roll crusher.

Wear caps are sacrificial components subjected to heavy erosion in abrasive environments. Typically, an array of 50-120 wear caps may be installed on a generally cylindrical roll. As shown in FIG. 1, during normal operation, the rolls 12 are rotated in opposite directions so that the tips 20 are driven in an arcuate path with the roll toward each other from the top of the roll. However, the rolls may be operated in the opposite direction for clearing the crusher. Additionally the rolls may be designed so that the tips are driven toward each other at the bottom of the roll during normal operation. The broken material 14A passing through the roll crusher is deposited on a conveyor (not shown) for transport to additional processing. Crushers may be run continuously in a mining operation and stopped only to replace the wear caps as they are worn away and/or conduct other maintenance. Minimizing the equipment downtime required for renewing the crusher with new caps reduces expenses and increases productivity. The present invention incorporates a stable mounting system with a single retainer, and lessens the time required to detach a wear cap from its base. The retainer preferably pulls the wear cap against a portion of the base to maintain a positional relationship of the wear cap with the base during operation. The use of wear caps in accordance with the preferred embodiment also reduces the cost as compared to conventional tips by reducing the throw-away material and eliminating the need to machine a mounting shank. The use of a diverging cavity to support the wear cap in lieu of a machined mounting shank in a conventional tip also eases and speeds removal and renewal of the roll crusher.

Wear assembly 20 includes a wear cap 22 mounted on a base 24 (FIGS. 2-9). Wear cap 22 is preferably a one piece cap with a forward working end 22A, a rearward mounting end 22B, at least one rearwardly extending projection or flange 26 and a rearward opening cavity 30 for receiving a seat 34 on a base 24. Cavity 30 defines a longitudinal axis 28 extending between the forward working end and the rearward mounting end generally in the direction of installation of the wear cap on the seat. Cavity 30 opens in a rear wall 22C of wear cap 22 and is configured to matingly receive seat 34 to mount wear cap 22 for operation. Cavity 30 and seat 34 are hidden in FIG. 2 and indicated by dotted lines.

In the illustrated embodiment, base 24 is defined as a holder securely mounted to roll 12 by welding, mechanical attachment or cast as part of the roll. Wear assembly 20 is engineered to impact consolidated material 14 at the working end 22A and separate it into manageable portions. The generated force of the impact at working end 22A is transferred through the wear cap, the mounting end 22B and base 24 to roll 12 with minimal shifting of the components. Shifting of the wear cap on the base generates excess heat and excessive wear at the mating surfaces and reduces efficiency of the machine.

Alternatively, the wear cap can be mounted on a base in the form of an adapter mounted in a holder secured to the roll. The adapter can include a seat that is received by the wear cap and the base receives the adapter to securely mount the wear cap to the roll. Additional details concerning wear cap assemblies using an adapter are disclosed in International Publication No. WO2012/142535 which is incorporated herein by reference in its entirety.

In another alternative, the wear cap can be mounted on a base in the form of a conventional shank such as disclosed in US Patent Publication 20090174252 titled "Tip for an Earth Working Roll" which is incorporated herein by reference in its entirety. This construction can be beneficial for retrofitting existing machines.

In one preferred construction, cavity 30 includes upper and lower surfaces 30A and 30B, side stabilizing surfaces 30C and side transition surfaces 30D. Side stabilizing surfaces 30C axially extend substantially parallel to the longitudinal axis for improved stability and support to resist transverse forces. The term substantially parallel in this application refers to surfaces that are parallel to or diverge extending along the longitudinal axis at an angle of seven degrees or less. The side walls preferably diverge five degrees or less, and most preferably extend an angle of 2-3 degrees to the longitudinal axis in the rearward direction. A slight divergence is preferred for casting of the caps.

Upper and lower bearing surfaces 30A and 30B and side transition surface 30D face generally inward and rearward from the direction of rotation R1. Cavity 30 with rearward facing surfaces 30A, 30B and 30D generally diverges and opens toward rear wall 22C extending along longitudinal axis 28. Conversely, cavity 30 generally tapers extending forward. This taper enables easier removal of the wear cap and permits widening of the seat for strength.

Figure 5:
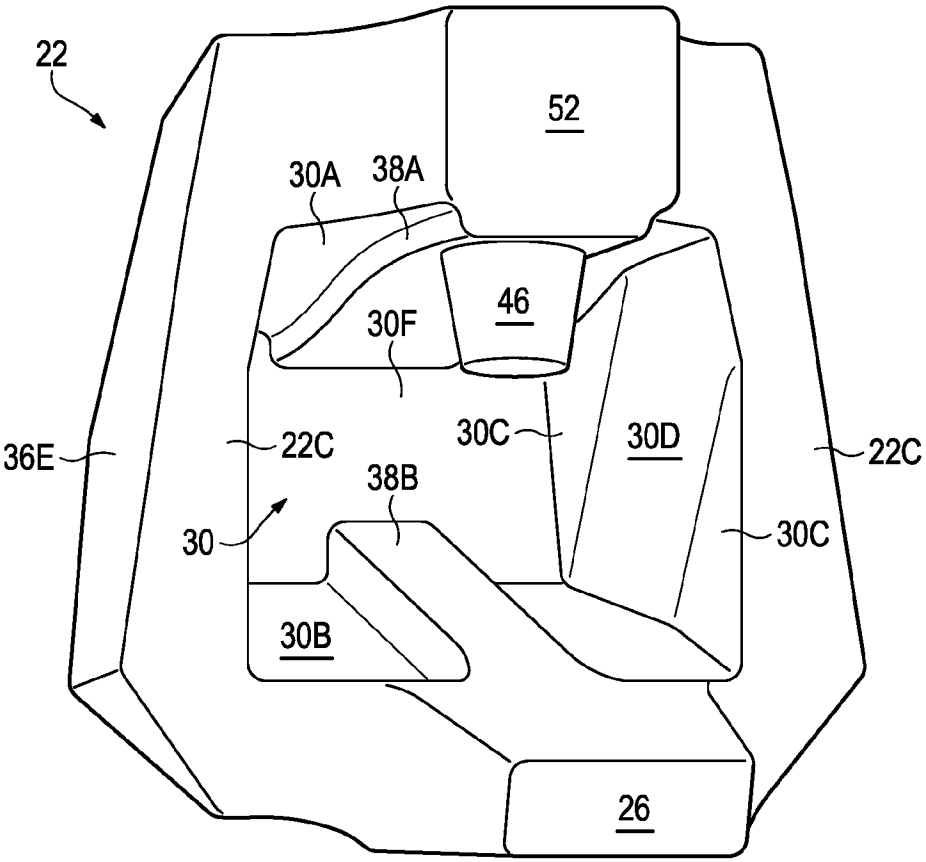
FIG. 5 is a rear perspective view of the wear cap.

Cavity 30 may also include a rail or groove separate and spaced from the stabilizing surfaces 30C that engages the other of a groove or rail on seat 34. In the illustrated embodiment, rail 38A and 38B are shown as a protrusion from the upper and lower bearing surfaces 30A and 30B (FIG. 5). The rails 38A and 38B could be arcuate in transverse cross section or could be defined by planar surfaces forming a step on the bearing surface. The rails 38A and 38B are shown extending rearward in cavity 30. A rail could be formed on only one of the upper and lower surfaces 30A and 30B, along the sidewalls as disclosed in US Patent Publication 20090174252, along at least one of the upper or lower surface 30A, 30B and the sidewalls, or could be omitted entirely.

Figure 2:
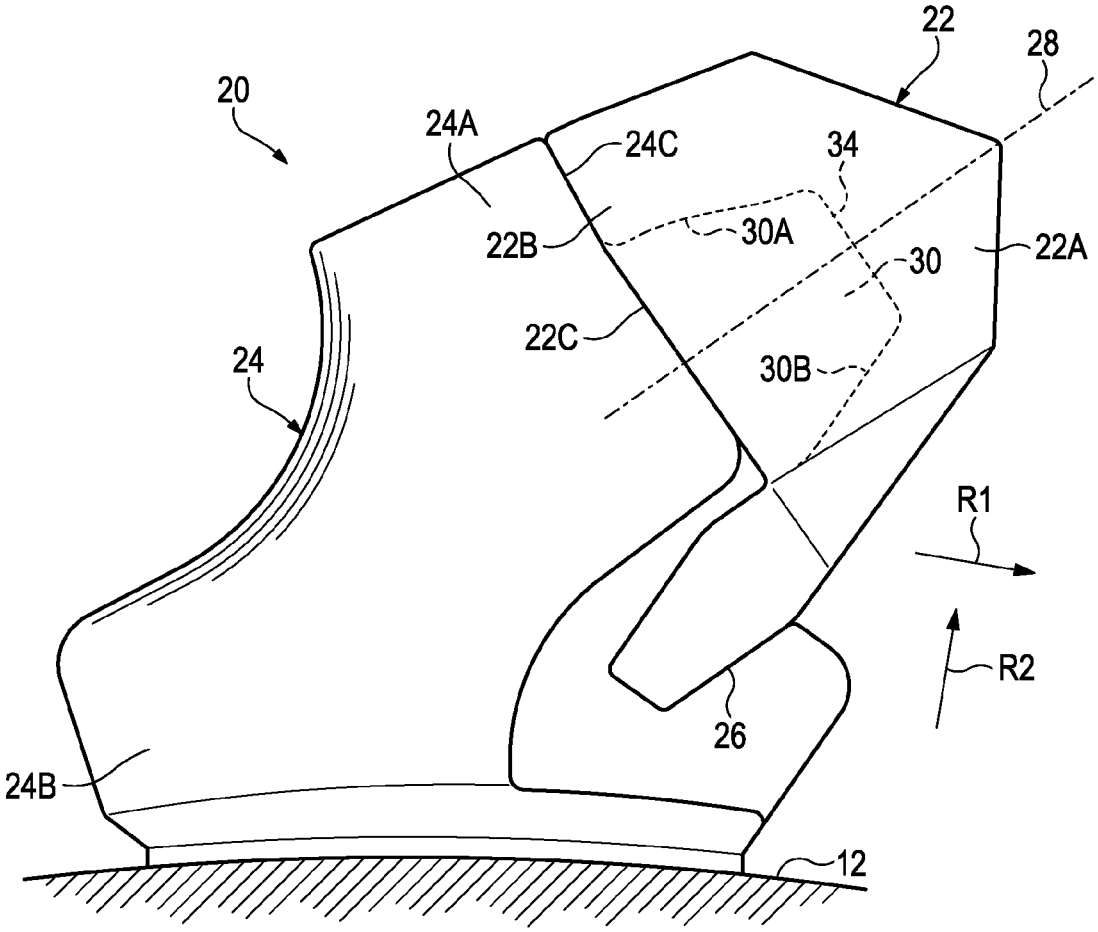
FIG. 2 is a side view of a wear assembly with a wear cap and a base attached to a roll in accordance with the present invention.
Figure 4A:
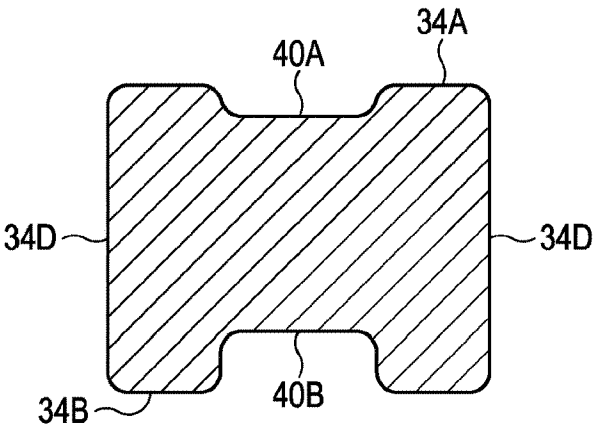
FIG. 4A is a cross section of the seat of the base taken along line 4A-4A in FIG. 4.
Figure 4:
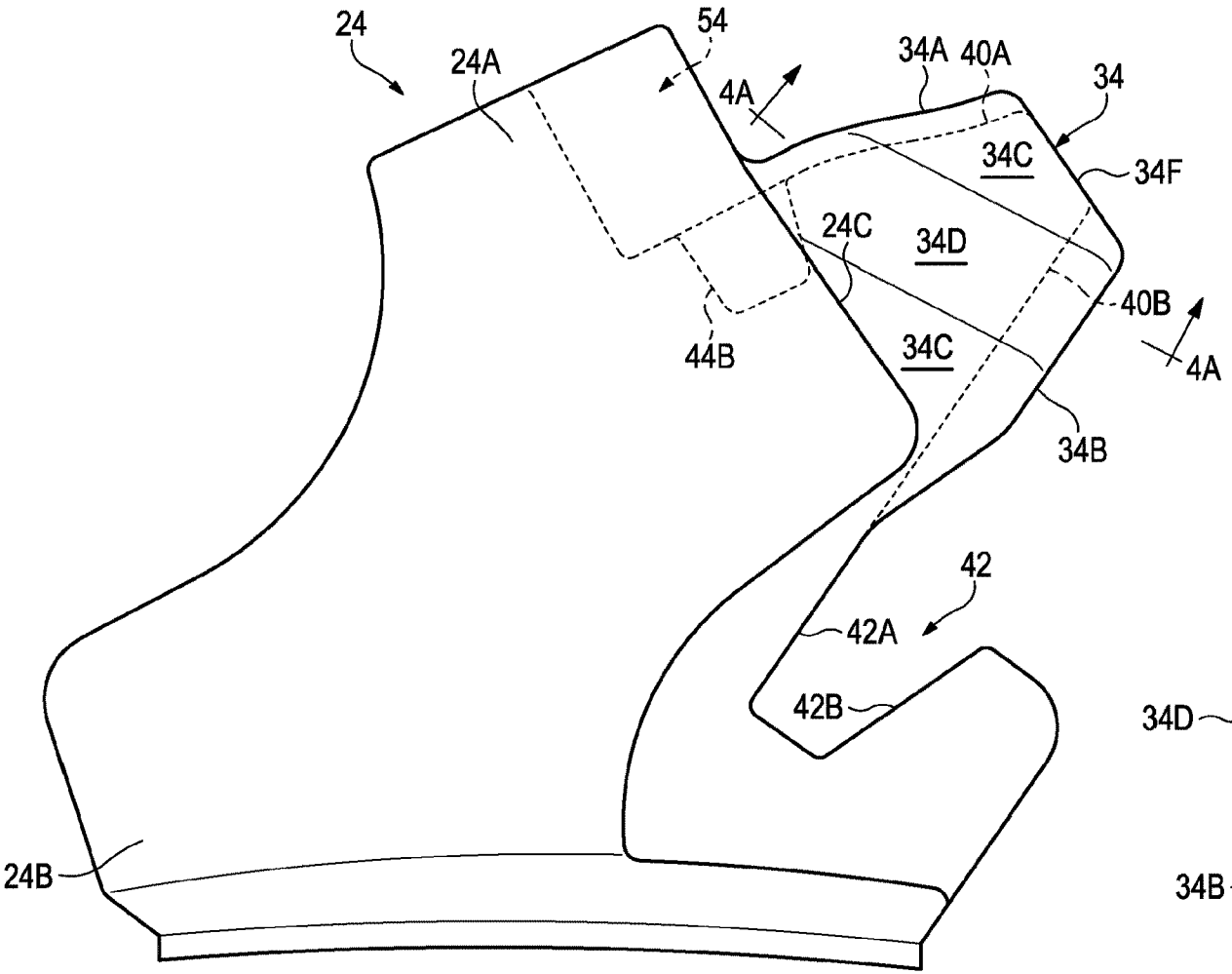
FIG. 4 is a side view of the base.
Figure 8:
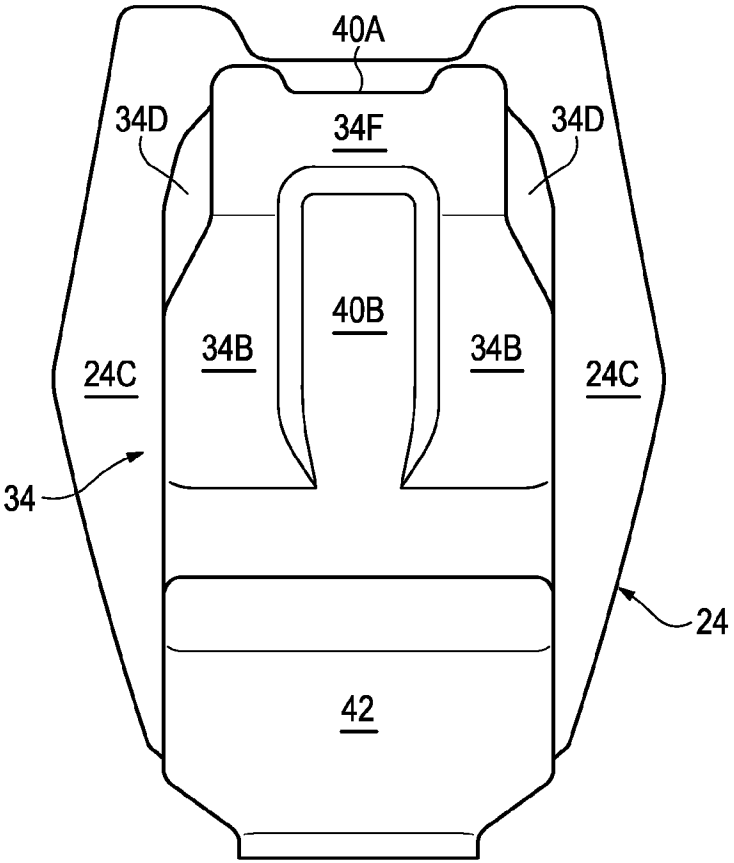
FIG. 8 is a front elevation view of the base.

Base 24 includes a forward seating end 24A, a rearward mounting end 24B and a front wall 24C at seating end 24A (FIGS. 2, 4, and 8). Seat 34 includes upper and lower bearing surfaces 34A and 34B, side stabilizing surfaces 34C and transition surfaces 34D to complement surfaces 30A-D in cavity 30. Side stabilizing surfaces 34C axially extend substantially parallel to longitudinal axis 28. Upper and lower surfaces 34A and 34B and transition surface 34D face generally forward in the direction of, and converging along, longitudinal axis 28 providing a forward taper to seat 34.

When cavity 30 receives seat 34, corresponding surfaces of cavity 30 and seat 34 are juxtaposed and in opposition. Top and bottom surfaces 34A and 34B of seat 34 and top surface 30A and bottom surface 30B of cavity 30 face each other. These surfaces may or may not bear against each other on assembly. In operation these surfaces bear against each other to resist and absorb the applied loads. Front or thrust surface 34F of seat 34 and front or thrust surface 30F of cavity 30 face each other and side stabilizing surfaces 34C and side surfaces 30C face each other. In operation the side surfaces of the seat and cavity bear against each other to resist and absorb side impacts and loads.

Preferably, the seat and the cavity include front and rear side stabilizing surfaces 30C and 34C axially extending substantially parallel to the longitudinal axis to help stabilize the fit of the wear cap 22 on seat 34 during use. For example, a load that transmits lateral forces to the wear cap will be resisted (in part) by the forward side stabilizing surfaces on the side where the force is applied and the rearward side stabilizing surfaces 30C on the opposite side. The axial extension substantially parallel to the longitudinal axis reduces the tendency of the wear caps to be pushed from the seat. As a result, wear cap movement on the seat is reduced for less wear and the load on the retainer is reduced.

Figure 3:
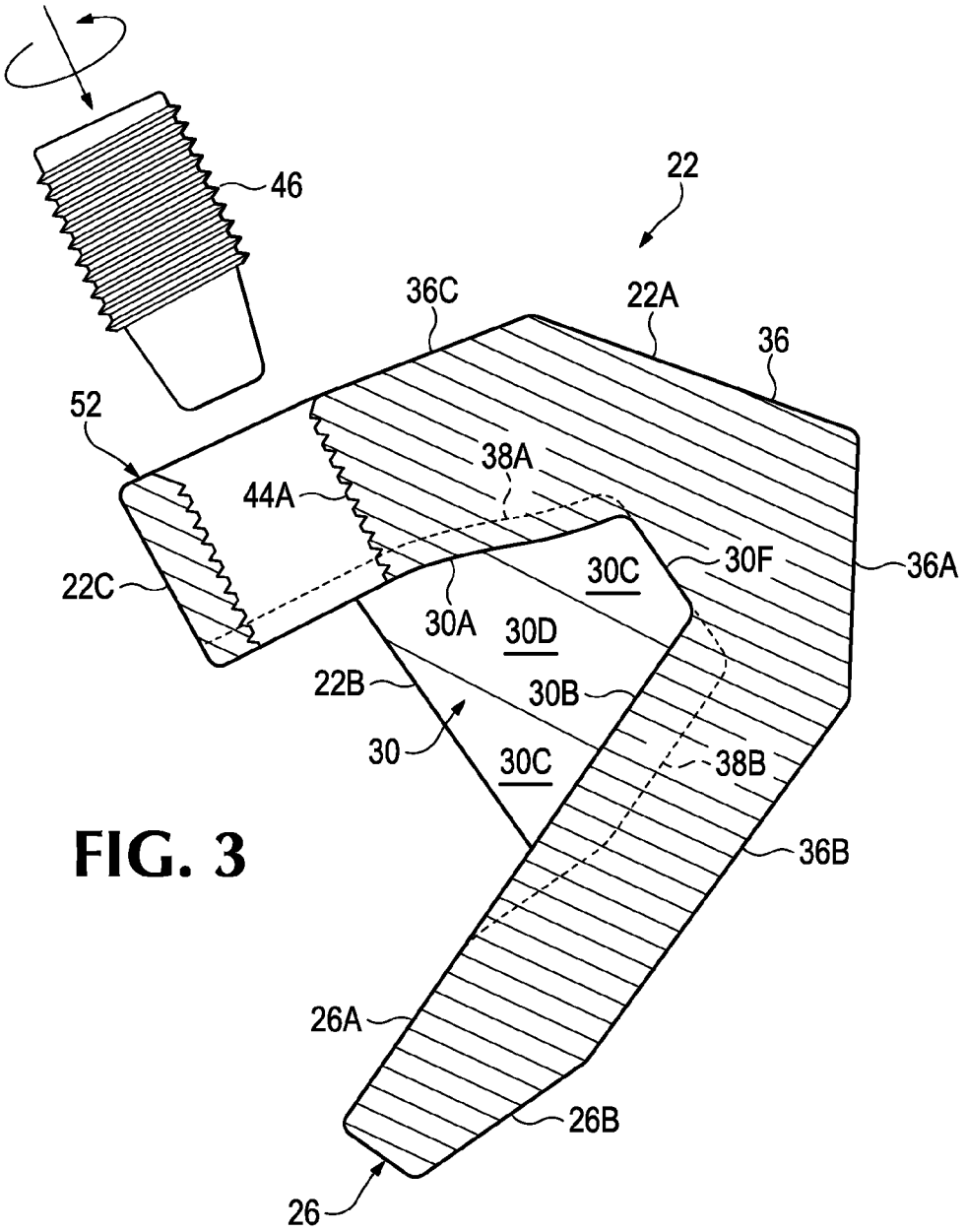
FIG. 3 is a side cross-section view of the wear cap.

Side stabilizing surfaces 30C could each be a single surface, but are preferably separated by transition surfaces 30D to enable widening of the seat 34 for greater strength. In a preferred embodiment, the transition surfaces 30D are inclined relative to the longitudinal axis as they extend between upper bearing surface 30A and lower bearing surface 30B. As seen in FIG. 3, transition surfaces 30D are proximate rear wall 22C when adjacent upper bearing surface 30A, and proximate thrust face 30F when adjacent lower bearing surface 30B. This arrangement of the transition surfaces 30D provides improved support for the loads as expected for a roll crushing operation. The transition surfaces 30D, however, could have a different inclination, a reverse inclination or no inclination.

Side stabilizing surface 30C may not be in contact with stabilizing surface 34C when the wear cap is initially installed on the seat, i.e., there may be a small gap between the side stabilizing surfaces. This spaced assembly allows for easier manufacturability by increasing the tolerances between the inter fit pieces. As the wear cap encounters a force the side stabilizing surfaces of the seat and cavity bear against each other to resist and absorb the force. As the tip continues to operate, fines may fill in the gap between the stabilizing surfaces to lessen the rattle of the wear cap on the seat. Still, the side stabilizing surfaces 30C and 34C could be manufactured to be in contact upon initial assembly.

Front wall 24C of the base and rear wall 22C of the wear cap preferably remain spaced from each other and do not act as bearing surfaces, i.e., there is a gap between the walls. Transition surfaces 30D and 34D face each other on assembly. Transition surfaces 30D and 34D preferably maintain a spaced relationship in operation and are not intended as primary bearing surfaces to absorb loads during operation. The spaced surfaces 22C, 24C and 30D, 34D may contact each other during use or could be designed to contact each other. The side transition surfaces together with the converging top and bottom surfaces provide for the forward tapering configuration of the exterior surfaces 36A-E of wear cap 22.

Seat 34 may further include one or more rails or grooves that engage the other of one or more corresponding grooves or rails in cavity 30. Top and bottom surfaces 34A and 34B of seat 34 are shown with grooves 40A and 40B. Grooves 40A and 40B could be arcuate in transverse cross section or could be defined by planar surfaces forming a step on top and bottom surfaces 34A and 34B. Grooves 40A and 40B corresponds to the shape of rail 38 and extends rearward on seat 34. Grooves 40A and 40B receive rails 38A and 38B on cavity 30 receiving seat 34.

Rails 38A and 38B are preferably formed on the wear cap to add strength to wear cap 22 and provide for thinner wear cap top and bottom walls than would be possible without the rails. The rails 38A and 38B of cavity 30 engage the grooves on seat 34 and provide additional stabilization and side support. The provision of a rail in the upper surface 30A of cavity 30 also provides a larger base for a retainer, i.e., more threads in the wear cap for a transversely oriented retainer or a larger diameter for a retainer oriented in the direction of the longitudinal axis. Alternatively, rails could be formed on top and bottom surfaces of the seat for receipt in complementary grooves in the cavity of the wear cap.

A cross section of seat 34 through transition surfaces 34D will preferably be substantially "H" shaped, but other configurations are possible (FIG. 4A), but other shapes are possible. The top groove 40A forms an indentation on the top surface 34A and the bottom groove 40B forms an indentation on the bottom surface 34B in the cross section. The top and bottom surfaces of the seat resist vertical loads applied to the wear cap though an initial gap is preferred to ease manufacturing and fit. The grooves accept the rails of the wear cap that provide strength to the top and bottom walls of the wear cap and the rails in the grooves resist side loads during operation.

A projection or flange 26 preferably extends rearward from the lower surface 30B of cavity 30 and rear wall 22C of wear cap 22. Flange 26 includes upper and lower bearing surface 26A and 26B. Base 24 further includes a complementary recess 42 at the seating end of base 24. Recess 42 is partially defined by bearing surfaces 42A and 42B between which is received flange 26. Upper and lower recess surfaces 42A and 42B face upper and lower flange surfaces 26A and 26B on assembly of wear cap 22 to seat 34.

Figure 6:
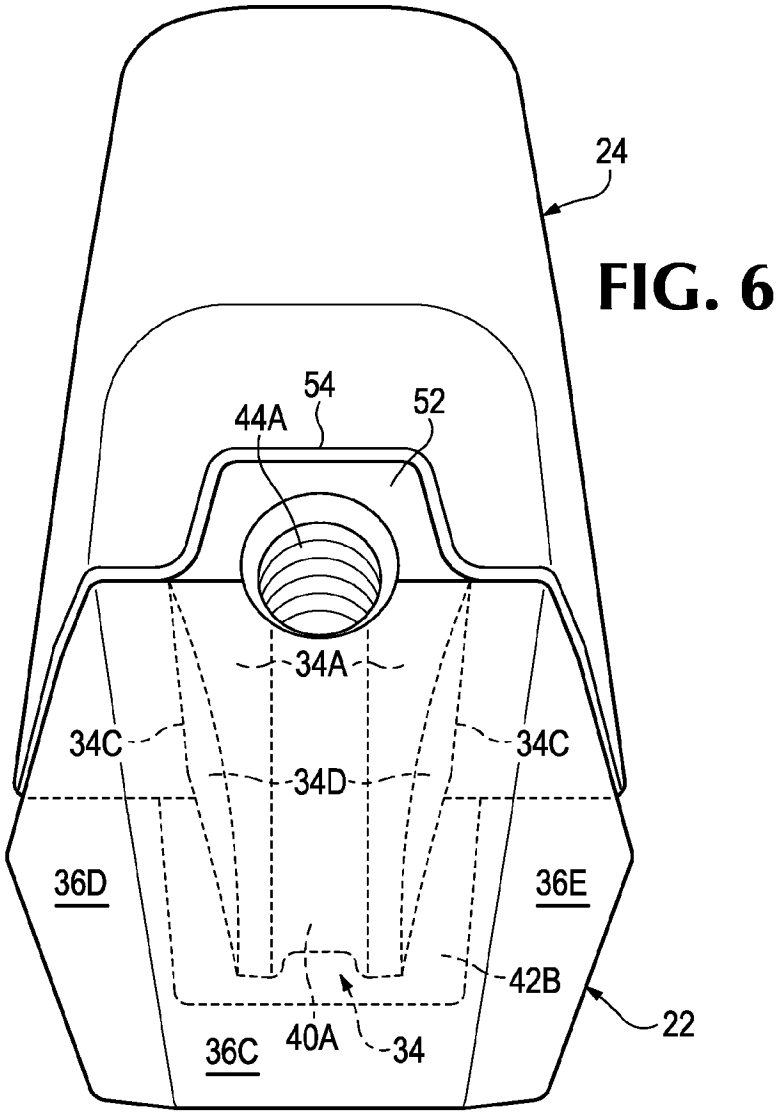
FIG. 6 is a top view of the wear assembly.
Figure 7:
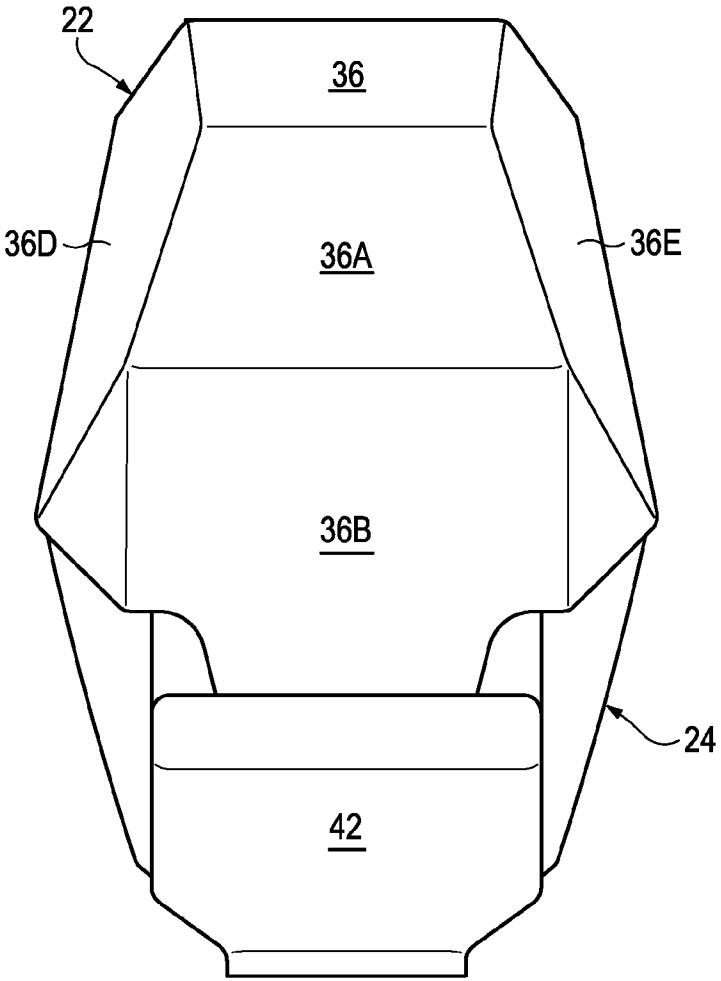
FIG. 7 is a front elevation view of the wear assembly.
Figure 9:
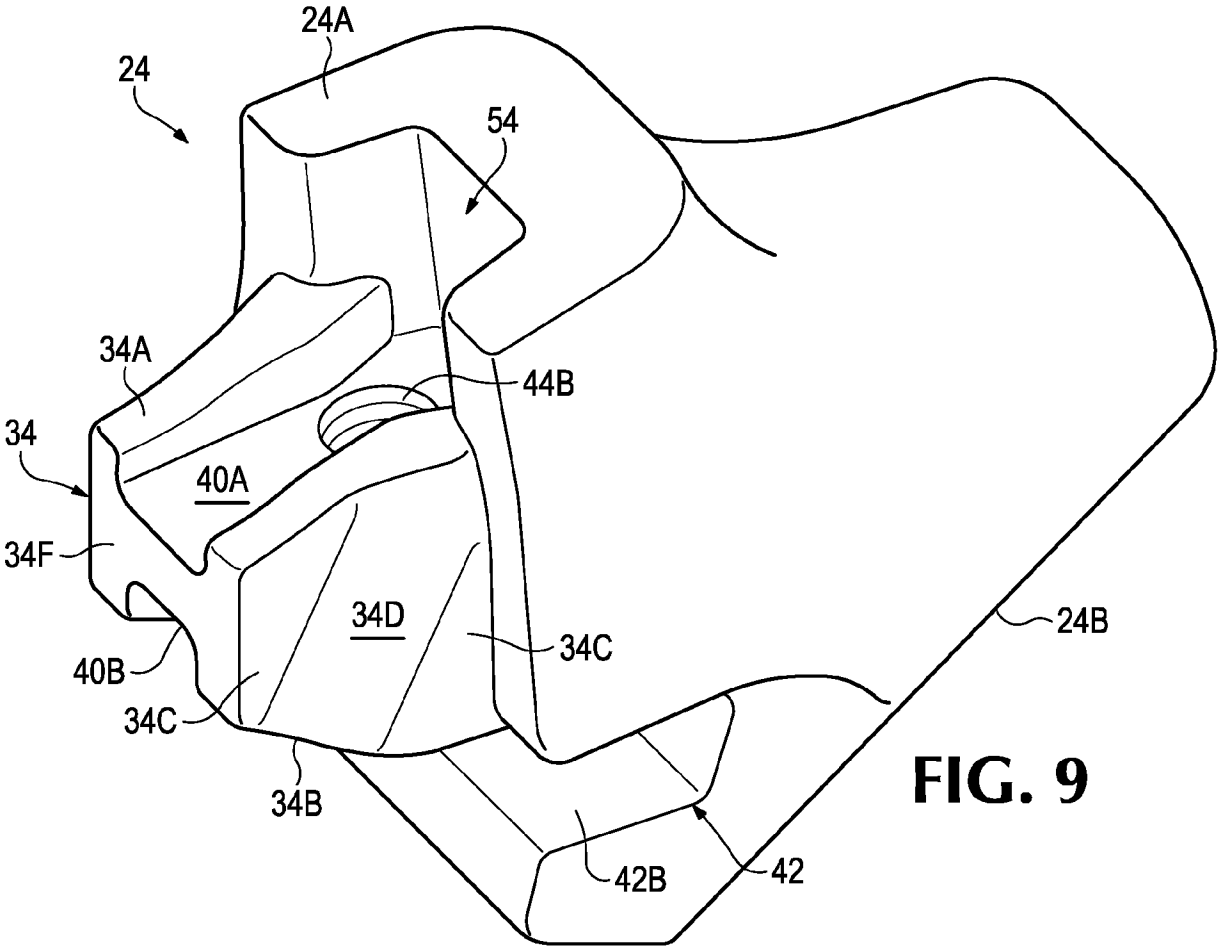
FIG. 9 is a perspective view of the base.

Wear cap 22 includes a strike or impact face 36, a front face 36A, lower face 36B, trailing face 36C and left and right sides 36D and 36E shown in FIGS. 3, 6, and 7. Roll 12 has an operational direction of rotation R1 and a radial direction away from the rotational axis R2. Front face 36A and lower face 36B generally face in the direction R1. Trailing face 36C generally faces away from direction R1. The strike face is arranged to oppose a strike face in the opposite roll during rotation to crush the material to a certain size. The faces generally diverge rearward from the front face. Impact face 36 and front face 36A make initial contact with the material as the drum rotates to fracture, separate and reduce the material to a smaller size. The other secondary faces of the wear cap including top, bottom and side surfaces generally make a secondary impact on the target materials.

Materials also impact and wear on base 24 requiring the base to be replaced periodically, although not as frequently as the wear cap. Alternatively, a sacrificial shroud (not shown) can be fixed to the base 24 to limit material impact and wear of the base.

Roll 12 operates at a high speed and the array of assemblies impact and fractures the target materials with significant force. The impact deflects material in all directions which impact the side surfaces and generate transverse forces between the wear cap and the seat. Deflected materials also impact the bottom and top faces as well, generating additional vertical forces between the wear cap and the seat.

Wear cap 22 at rear wall 22C preferably includes a projection or protrusion 52 at the upper end of cap 22 that extends rearward of wall 22C. Base 24 has a cooperating recess or notch 54 rearward of wall 24C configured to receive protrusion 52 when wear cap 22 receives seat 34. Preferably, notch 54 supports at least the sides of protrusion 52, but in some cases additional benefit may be achieved in the notch also supporting the top and/or bottom surfaces of the protrusion (not shown). Protrusion 52 provides support for opening or hole 44A that passes through top face 36C of wear cap 22 provides further resistance to applied loads and allows a retainer 46 in opening 44A to engage opening or hole 44B at a position farther back on seat 34 and wear cap 22. This more rearward position for the retainer provides additional leverage in retaining the wear cap to the seat.

As discussed above, a pair of projections preferably extends from both the upper and lower ends of wear cap 22. The projection 26 extending from the bottom end of wear cap 22 preferably limits movement of the wear cap as will be discussed below and the projection 52 extending from the upper end of wear cap 22 provides support for hole 44A as discussed above. Although it is preferable to have the construction described above, it is possible for both protrusions to limit the movement of the wear cap or for each protrusion to have a hole for receiving a retainer to secure the wear cap to the seat. However, there is benefit from having just one protrusion extending from the upper or lower surfaces of the cavity. In addition, protrusions may extend from the side surfaces as disclosed in US Patent Publication 20090174252, from at least one of the upper or lower surface and the side surfaces, or could be omitted entirely. In addition one of the protrusions may extend farther rearward than the other protrusion.

Opening 44A threadedly receives retainer 46 in a direction generally transverse to the longitudinal axis. Seat 34 includes opening 44B at upper surface 34A. When wear cap 22 fully receives seat 34 in cavity 30, cap opening 44A generally aligns with seat opening 44B. Inserting retainer 46 in opening 44A and turning the retainer advances the retainer in threaded opening 44A. Retainer 46 advances until the free end extends beyond the upper surface 30A and advances into cavity 30 and seat opening 44B.

In a preferred embodiment, opening 44B is an unthreaded blind hole and retainer 46 and/or opening 44B includes a tapered portion. The tapered portions of the opening and/or retainer facilitate alignment of the openings 44A and 44B where they are not completely aligned as the retainer advances. Retainer 46 advances into opening 44B and retains the wear cap to the seat by shear on the retainer without providing take up to pull the wear cap tightly onto the seat. In an alternative embodiment, retainer 46 is advanced further into opening 44B to contact a bottom surface of the opening. Tightening the retainer against the bottom of the opening biases the wear cap 22 on the seat 34 so bottom surfaces 30B and 34B bear against each other and are preloaded.

Alternatively, retainer 46 and opening 44B are configured to bias the wear cap rearward onto seat 34. Retainer 46 advances a tapered portion into opening 44B and makes contact with the front surface of opening 44B. As the retainer advances further into the opening a wider portion of the retainer makes contact with the front of the opening and the wear cap is urged rearwardly in relation to the seat. As the wear cap is biased rearward, the corresponding thrust faces 30F and 34F and bottom surfaces 30B and 34B bear against each other. Such take up enable wear parts to be fit tightly together to reduce wearing and to continue to fit tightly even when wear on a partially used nose begins to appear. In certain embodiments, a gap can be formed between front surfaces 30F and 34F.

Alternatively, opening 44B can be threaded and opening 44A unthreaded. Opening 44A or 44B may include a resilient material to limit free rotation of the retainer, or other arrangements could be used to resist loosening such as lock nuts, etc. Retainer 46 can be a bolt. Retainer 46 may have a frustoconical configuration with threads on the frustoconical surface such as in U.S. Pat. No. 7,536,811, which is incorporated herein by reference in its entirety. Alternatively, retainer 46 could use an unthreaded retention method such as a quarter turn latch or a retention pin (which typically requires a hammer). Examples of alternative locks may be found in U.S. Pat. No. 8,469,622 or U.S. patent application Ser. No. 13/547,353 which are incorporated herein by reference in their entirety.

While crusher 10 operates predominantly by rotating rolls 12 in a direction R1, the rolls are operated in the opposite direction for clearing the crusher. Objects are sometimes introduced into the operation that cannot be processed by the crusher such as certain kinds of rock, broken machinery pieces or wear members that have fallen off excavators. Removing them from the crusher, or clearing the crusher for maintenance or other operations, often requires reversing the direction of rotation. During reverse rotation material infeed is typically suspended, but reverse operation still generates significant forces on the wear cap that can tend to pull the wear cap off the seat if not sufficiently supported.

In reverse rotation, base 24 initially impacts target materials rather than front faces 36 or 36A of the wear cap impacting target materials as occurs in forward operation. The forward tapering of exterior surfaces of the wear cap lessen the drag on the wear cap 22, but materials still drag on the top and side surfaces of wear cap 22 and on rear wall 22C where it intersects with the base. These drag forces tend to pull the wear cap off the seat. Flange 26 and retainer 46 in opening 44 oppose the extraction forces on the wear cap during reverse rotation of drum or roll 12 as well as during normal operation. Flange 26 bears against surface 42B and with retainer 46 in holes 44A and 44B act to resist the extraction forces as shear force on the retainer.

Alternatively, seat 34 could make an interference fit with cavity 30. On assembly, the top and bottom surfaces of the seat and the cavity, which diverge extending rearward, would make contact with the cavity and seat and act as bearing surfaces. In this configuration, the thrust faces remain spaced on initial assembly.

Alternatively, on initial assembly or after a period of operation, the cap may fit on the base so that the corresponding surfaces may make contact but are not preloaded to bear on each other. Retainer 46 in opening 44 together with flange 26 in recess 42 then primarily function to limit movement of wear cap in pulling off or away from base 24 and seat 34.

Wear caps erode and lose material rapidly in an abrasive environment and need to be replaced on a regular basis. Previous systems have a relatively complex retention system with multiple parts including bolts, adapters and/or components that require sophisticated machining for close tolerances. On a roll with 100 or more pick assemblies where the retainers tend to be clogged with fines, downtime for maintenance and replacement of worn components can be significantly reduced by using a less complex retention system. Using a single retainer to stably retain the wear cap to the base has a significant advantage in reducing machine downtime during maintenance. In addition, by locating the retainer in a top surface of the wear cap, the retainer is oriented upward and spaced outward from the roll to be easily accessed by the user. The construction of the present invention allows manufacture by a low cost casting operation without extensive machining for close tolerances as is required in conventional tips.

Figures 10, 11:
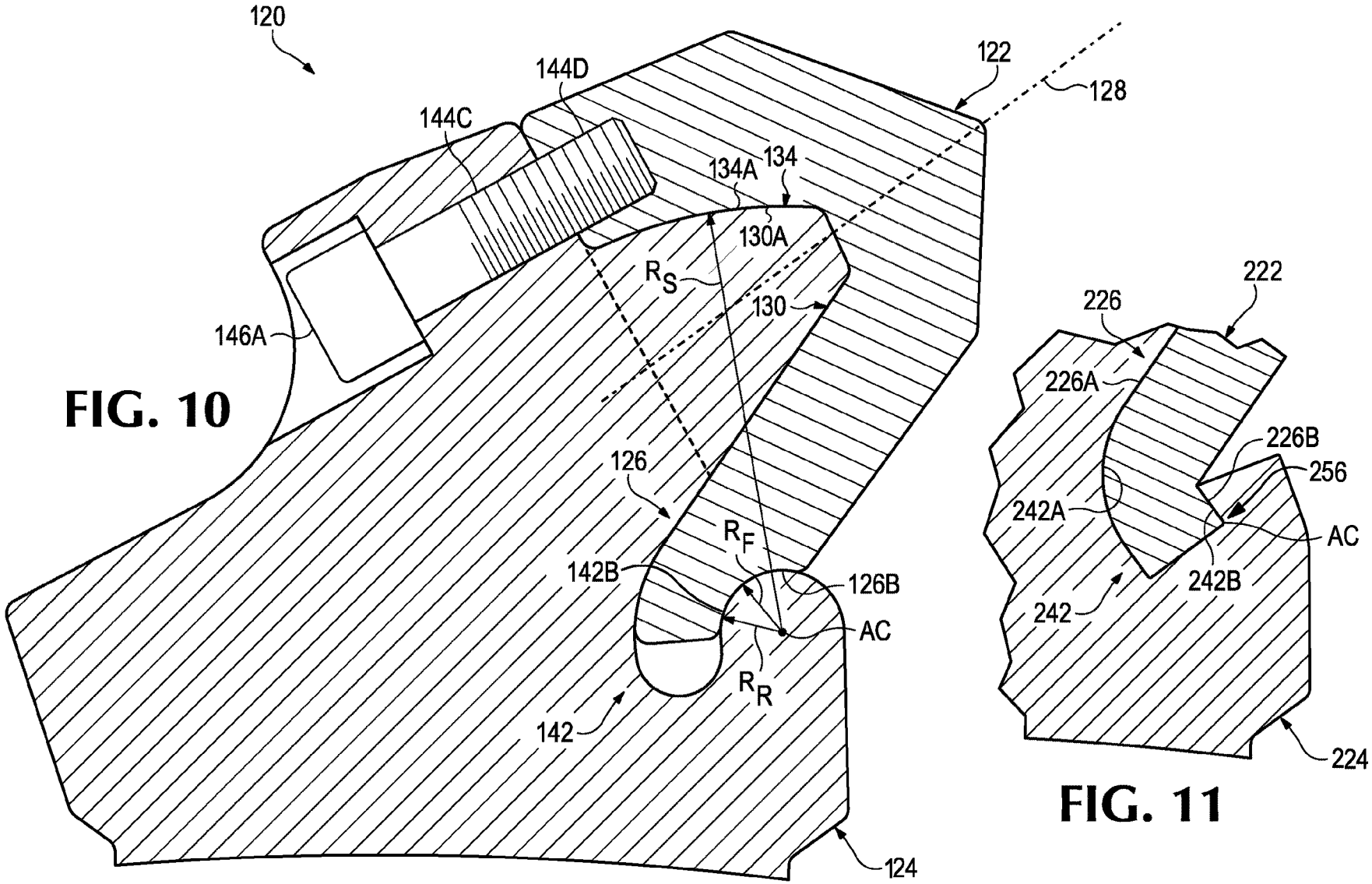
FIG. 10 is a side cross-section view of the wear assembly.
FIG. 11 is a side cross-section view of a detail for the wear assembly.

FIG. 10 is an alternative configuration of wear assembly 20. Wear assembly 120 includes a wear cap 122, a base 124, a cavity 130 and a seat 134 received by cavity 130. In this embodiment, base 124 includes an unthreaded opening 144C that accepts retainer 146A. Cap 122 includes a threaded opening 144D for engaging retainer 146A. Openings 144C and 144D are parallel to, or generally aligned with longitudinal axis 128. Although this kind of retainer is shown in a different construction, it can be used with the first (or other) embodiments.

Wear assembly 120 preferably includes many of the same features as wear assembly 20. For example wear assembly 120 preferably includes rails and grooves on top and bottom surfaces of the cavity and seat as well as corresponding side surfaces, transition surfaces and thrust faces.

Retainer 146A preferably includes a head larger than the threaded portion of the retainer. Once advanced into opening 144D, the head seats against a surface adjacent to opening 144C of base 124, but other arrangements are possible. Advancing retainer 146A further pulls cap 122 tight onto seat 134. Opening 144C may further include a countersink to accept the head of retainer 146A below the surface of base 124 to reduce wearing during use.

These are preferred examples of wear assemblies in accordance with the present invention. Retainer 146A and corresponding opening configurations can take different forms and have different features to perform a similar function and still fall within the scope of this disclosure.

FIG. 10 shows recess 142 and flange 126 configured with complementary curves such that when complementary curve surfaces are in contact, they have a common axis of curvature. The axis of curvature is indicated by AC. Three radii from axis of curvature AC are shown: Rf for the flange bearing surface 126B, Rr for the recess lower bearing surface 142B and Rs for the seat upper bearing surface 134A. While the radii are shown with a common axis of curvature, each axis may approach axis AC and the surface of the component may vary from a circular arc to account for variations in casting and to limit binding of the components on assembly. Mounting wear cap 122 to base 124 with this configuration requires first inserting the end of flange 126 in the opening of recess 142. Wear cap 122 is then rotated about the common axis of the curves of flange 126 and recess 142.

In order for wear cap 122 to rotate about the common axes onto seat 134, upper bearing surfaces 130A of the wear cap and the upper bearing surface 134A of the seat 134 may be curved with an axis of curvature AC approaching that of flange 126 and recess 142. This allows wear cap 122 to rotate over seat 134 without interference and set against seat 134 when fully installed. Alternatively, upper surface 130A may alternatively be flat and extend rearward diverging from the longitudinal axis such that the wear cap rotates fully onto seat 134 without interference.

Cavity 130 receives seat 134 and an opening 144C of base 124 aligns with an opening 144D. Opening 144C is shown as a through hole and is preferably unthreaded. Opening 144D in wear cap 122 is threaded so that advancing the retainer through opening 1440 to engage threads in opening 144D pulls wear cap 122 onto seat 134.

In an alternative embodiment shown in FIG. 11, flange 226 and recess 242 are preferably curved at upper bearing surfaces 226A and 242A with a common axis of curvature. Lower flange surface 226B forms an interlocking latch 256 with recess lower surface 242B proximate to the axis of curvature AC. In this configuration wear cap 222 would be mounted to base 224 in a similar manner as discussed for the previous embodiment by rotating wear cap 222 about the common axis of curvature until the cavity bears on the seat. Once seated, lower bearing surface 226B of flange 226 bears against lower bearing surface 242B of recess 242 along a direction generally parallel to the longitudinal axis. This latching flange and recess provides a positive retention of the lower portion of wear cap 222 to base 224.

Although preferred embodiments are described above for a two piece cap assembly, other arrangements in accordance with the invention are possible. Different aspects of the invention can be used in isolation to achieve some of the benefits of the invention. For example, a wide variety of different configurations could be used to form the cavity, the seat, the external wear surface, or the retainer and still achieve the benefits of discarding less material when the wear cap working end is worn out and provide a simpler cap replacement process.

For example, the wear cap could have a cone shaped exterior. Further, the front surface of the cap could be curved, pointed or have shapes and/or orientations other than planar and inclined to the longitudinal axis. The working end of the wear cap may also be provided with a carbide or hard material front surface, or with embedded carbide, ceramic or other wear resistant members, or with other wear resistant means besides hardfacing.

Although the application primarily discloses the use of caps in accordance with the present invention in conjunction with a double roll crusher, such caps could be used in other machines including, for example a scroll crusher.

The caps are at times described in this application in relative terms such as upper, lower, front, rear, vertical, horizontal and the like. These relative directional terms are not essential to the invention. The orientations of the caps on an earth working roll change considerably during operation. Accordingly, the use of these relative terms is not to be limiting of the invention, but rather to clarify the description.

The invention claimed is:

1. A wear cap for attachment to a base secured to a driven roll in an earth working machine, the wear cap comprising:

a front end;

a rear end including a cavity with a top surface, a bottom surface, and sidewalls that opens rearward to receive a seat on the base and generally corresponds to the shape of the seat;

an upper end;

a lower end;

and a longitudinal axis extending rearward from the front end, the cavity includes a plurality of side stabilizing surfaces on each of the sidewalls, each stabilizing surface axially extends substantially parallel to the longitudinal axis to engage a plurality of side stabilizing surfaces on the seat, each said side stabilizing surface on each of the sidewalls is separated by a transition surface, and the transition surfaces diverge rearwardly, and the cavity includes a rail or groove in each of the top and bottom surfaces, the rails or grooves engage respective top and bottom rails or grooves on the seat wherein each of the transition surfaces are closer to the rear end when proximate the upper end and closer to the front end when proximate the lower end.

2. A wear cap in accordance with claim 1 wherein each of the transition surfaces are inclined to the longitudinal axis at an acute angle.

3. A wear cap in accordance with claim 1 wherein top surface the cavity is curved.

4. A wear cap in accordance with claim 1 wherein the upper end of the wear cap includes a projection extending rearwardly from the rear end to fit within a recess in the base.

5. A wear cap in accordance with claim 4 wherein the projection includes a hole for receiving a retainer through the hole to engage the base.

6. A wear cap in accordance with claim 1 wherein the rear end of the wear cap includes a hole for receiving a retainer through the hole to engage the base.

7. A wear cap assembly for attachment to a driven roll in an earth working machine, the wear cap assembly comprising:

a base having a forward facing seat, a hole, and a mounting end to be secured to the roll;

a wear cap in accordance with claim 1 being separable from the base, a retainer to be received in the hole in the wear cap and the hole in the base to releasable hold the wear cap to the base.

8. A driven roll for an earth working machine, the driven roll being generally cylindrical and comprising:

a plurality of bases fixed to the roll, each of the bases having a forward facing seat, a hole, a recess, and a mounting end to be secured to the roll;

a plurality of wear caps in accordance with claim 1 separable from each of the bases; and a retainer to be received in the hole in the wear cap and the hole in the base to releasably hold the wear cap to the base.

* * * * *